US008151875B2

(12) United States Patent
Johnson

(10) Patent No.: US 8,151,875 B2
(45) **Date of Patent: *Apr. 10, 2012**

(54) DEVICE AND SYSTEM FOR WELL COMPLETION AND CONTROL AND METHOD FOR COMPLETING AND CONTROLLING A WELL

(75) Inventor: Michael H. Johnson, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/946,397

(22) Filed: Nov. 15, 2010

(65) Prior Publication Data

US 2011/0056688 A1 Mar. 10, 2011

Related U.S. Application Data

(63) Continuation of application No. 12/171,539, filed on Jul. 11, 2008, now Pat. No. 7,913,755, which is a continuation of application No. 11/875,584, filed on Oct. 19, 2007, now Pat. No. 7,918,272.

(60) Provisional application No. 61/052,919, filed on May 13, 2008.

(51) Int. Cl.
*E21B 43/08* (2006.01)

(52) U.S. Cl. ..... 166/227; 166/205

(58) Field of Classification Search ..... 166/227–236, 166/56, 276, 157, 205; 405/43–50
See application file for complete search history.

(56) References Cited

U.S. PATENT DOCUMENTS

| | | | |
|---|---|---|---|
| 1,362,552 | A | 12/1920 | Alexander et al. |
| 1,488,753 | A | 4/1924 | William |
| 1,649,524 | A | 11/1927 | Hammond |
| 1,915,867 | A | 6/1933 | Penick |
| 1,984,741 | A | 12/1934 | Harrington |
| 2,089,477 | A | 8/1937 | Halbert |
| 2,119,563 | A | 6/1938 | Wells |
| 2,214,064 | A | 9/1940 | Niles |
| 2,257,523 | A | 9/1941 | Combs |
| 2,391,609 | A | 12/1945 | Wright |
| 2,412,841 | A | 12/1946 | Spangler |
| 2,762,437 | A | 9/1956 | Egan et al. |
| 2,804,926 | A | 9/1957 | Zublin |

(Continued)

FOREIGN PATENT DOCUMENTS

| | | |
|---|---|---|
| CN | 1385594 | 12/2002 |

(Continued)

OTHER PUBLICATIONS

An Oil Selective Inflow Control System; Rune Freyer, Easy Well Solutions: Morten Fejerskkov, Norsk Hydro; Arve Huse, Altinex; European Petroleum Conference, Oct. 29-31, Aberdeen, United Kingdom, Copyright 2002, Society of Petroleum Engineers, Inc.

(Continued)

*Primary Examiner* — Kenneth L Thompson
(74) *Attorney, Agent, or Firm* — Cantor Colburn LLP

(57) ABSTRACT

A screen assembly includes a tubular having one or more openings therein. A screen disposed about the tubular. The one or more devices disposed within the one or more openings. The devices each include a beaded matrix and a housing. Also included is a method for completing a wellbore with a sand screen.

18 Claims, 6 Drawing Sheets

U.S. PATENT DOCUMENTS

| | | | |
|---|---|---|---|
| 2,810,352 | A | 10/1957 | Tumlison |
| 2,814,947 | A | 12/1957 | Stegemeier et al. |
| 2,942,668 | A | 6/1960 | Maly et al. |
| 2,945,541 | A | 7/1960 | Maly et al. |
| 3,103,789 | A | 9/1963 | McDuff |
| 3,240,274 | A | 3/1966 | Solum |
| 3,273,641 | A | 9/1966 | Bourne |
| 3,302,408 | A | 2/1967 | Schmid |
| 3,322,199 | A | 5/1967 | Van Note, Jr. |
| 3,326,291 | A | 6/1967 | Zandmer |
| 3,333,635 | A | 8/1967 | Crawford |
| 3,385,367 | A | 5/1968 | Kollsman |
| 3,386,508 | A | 6/1968 | Bielstein et al. |
| 3,419,089 | A | 12/1968 | Venghiattis |
| 3,451,477 | A | 6/1969 | Kelley |
| 3,468,375 | A | 9/1969 | States |
| RE27,252 | E | 12/1971 | Sklar et al. |
| 3,675,714 | A | 7/1972 | Thompson |
| 3,692,064 | A | 9/1972 | Hohnerlein et al. |
| 3,739,845 | A | 6/1973 | Berry et al. |
| 3,791,444 | A | 2/1974 | Hickey |
| 3,876,471 | A | 4/1975 | Jones |
| 3,918,523 | A | 11/1975 | Stuber |
| 3,951,338 | A | 4/1976 | Genna |
| 3,958,649 | A | 5/1976 | Bull et al. |
| 3,975,651 | A | 8/1976 | Griffiths |
| 4,153,757 | A | 5/1979 | Clark, III |
| 4,173,255 | A | 11/1979 | Kramer |
| 4,180,132 | A | 12/1979 | Young |
| 4,186,100 | A | 1/1980 | Mott |
| 4,187,909 | A | 2/1980 | Erbstoesser |
| 4,245,701 | A | 1/1981 | Chambers |
| 4,248,302 | A | 2/1981 | Churchman |
| 4,250,907 | A | 2/1981 | Struckman et al. |
| 4,257,650 | A | 3/1981 | Allen |
| 4,265,485 | A | 5/1981 | Boxerman et al. |
| 4,278,277 | A | 7/1981 | Krijgsman |
| 4,283,088 | A | 8/1981 | Tabakov et al. |
| 4,287,952 | A | 9/1981 | Erbstoesser |
| 4,390,067 | A | 6/1983 | Willman |
| 4,398,898 | A | 8/1983 | Odom |
| 4,410,216 | A | 10/1983 | Allen |
| 4,415,205 | A | 11/1983 | Rehm et al. |
| 4,434,849 | A | 3/1984 | Allen |
| 4,463,988 | A | 8/1984 | Bouck et al. |
| 4,484,641 | A | 11/1984 | Dismukes |
| 4,491,186 | A | 1/1985 | Alder |
| 4,497,714 | A | 2/1985 | Harris |
| 4,512,403 | A | 4/1985 | Santangelo et al. |
| 4,552,218 | A | 11/1985 | Ross et al. |
| 4,552,230 | A | 11/1985 | Anderson et al. |
| 4,572,295 | A | 2/1986 | Walley |
| 4,576,404 | A | 3/1986 | Weber |
| 4,577,691 | A | 3/1986 | Huang et al. |
| 4,614,303 | A | 9/1986 | Moseley, Jr. et al. |
| 4,649,996 | A | 3/1987 | Kojicic et al. |
| 4,817,710 | A | 4/1989 | Edwards et al. |
| 4,821,800 | A | 4/1989 | Scott et al. |
| 4,856,590 | A | 8/1989 | Caillier |
| 4,899,835 | A | 2/1990 | Cherrington |
| 4,917,183 | A | 4/1990 | Gaidry et al. |
| 4,944,349 | A | 7/1990 | Von Gonten, Jr. |
| 4,974,674 | A | 12/1990 | Wells |
| 4,997,037 | A | 3/1991 | Coston |
| 4,998,585 | A | 3/1991 | Newcomer et al. |
| 5,004,049 | A | 4/1991 | Arterbury |
| 5,016,710 | A | 5/1991 | Renard et al. |
| 5,040,283 | A | 8/1991 | Pelgrom |
| 5,060,737 | A | 10/1991 | Mohn |
| 5,107,927 | A | 4/1992 | Whiteley et al. |
| 5,132,903 | A | 7/1992 | Sinclair |
| 5,156,811 | A | 10/1992 | White |
| 5,188,191 | A | 2/1993 | Tomek |
| 5,217,076 | A | 6/1993 | Masek |
| 5,333,684 | A | 8/1994 | Walter et al. |
| 5,337,821 | A | 8/1994 | Peterson |
| 5,339,895 | A | 8/1994 | Arterbury et al. |
| 5,339,897 | A | 8/1994 | Leaute |
| 5,355,956 | A | 10/1994 | Restarick |
| 5,377,750 | A | 1/1995 | Arterbury et al. |
| 5,381,864 | A | 1/1995 | Nguyen et al. |
| 5,384,046 | A | 1/1995 | Lotter et al. |
| 5,431,346 | A | 7/1995 | Sinaisky |
| 5,435,393 | A | 7/1995 | Brekke et al. |
| 5,435,395 | A | 7/1995 | Connell |
| 5,439,966 | A | 8/1995 | Graham et al. |
| 5,511,616 | A | 4/1996 | Bert |
| 5,551,513 | A | 9/1996 | Surles et al. |
| 5,586,213 | A | 12/1996 | Bridges et al. |
| 5,597,042 | A | 1/1997 | Tubel et al. |
| 5,609,204 | A | 3/1997 | Rebardi et al. |
| 5,673,751 | A | 10/1997 | Head et al. |
| 5,803,179 | A | 9/1998 | Echols et al. |
| 5,829,520 | A | 11/1998 | Johnson |
| 5,831,156 | A | 11/1998 | Mullins |
| 5,839,508 | A | 11/1998 | Tubel et al. |
| 5,873,410 | A | 2/1999 | Iato et al. |
| 5,881,809 | A | 3/1999 | Gillespie et al. |
| 5,896,928 | A | 4/1999 | Coon |
| 5,944,446 | A | 8/1999 | Hocking |
| 5,982,801 | A | 11/1999 | Deak |
| 6,044,869 | A | 4/2000 | Koob |
| 6,068,015 | A | 5/2000 | Pringle |
| 6,098,020 | A | 8/2000 | Den Boer |
| 6,112,815 | A | 9/2000 | Boe et al. |
| 6,112,817 | A | 9/2000 | Voll et al. |
| 6,119,780 | A | 9/2000 | Christmas |
| 6,228,812 | B1 | 5/2001 | Dawson et al. |
| 6,253,847 | B1 | 7/2001 | Stephenson |
| 6,253,861 | B1 | 7/2001 | Carmichael et al. |
| 6,273,194 | B1 | 8/2001 | Hiron et al. |
| 6,301,959 | B1 | 10/2001 | Hrametz et al. |
| 6,305,470 | B1 | 10/2001 | Woie |
| 6,325,152 | B1 | 12/2001 | Kelley et al. |
| 6,338,363 | B1 | 1/2002 | Chen et al. |
| 6,367,547 | B1 | 4/2002 | Towers et al. |
| 6,371,210 | B1 | 4/2002 | Bode et al. |
| 6,372,678 | B1 | 4/2002 | Youngman et al. |
| 6,419,021 | B1 | 7/2002 | George et al. |
| 6,474,413 | B1 | 11/2002 | Barbosa et al. |
| 6,505,682 | B2 | 1/2003 | Brockman |
| 6,516,888 | B1 | 2/2003 | Gunnarson et al. |
| 6,530,431 | B1 | 3/2003 | Castano-Mears et al. |
| 6,561,732 | B1 | 5/2003 | Bloomfield et al. |
| 6,581,681 | B1 | 6/2003 | Zimmerman et al. |
| 6,581,682 | B1 | 6/2003 | Parent et al. |
| 6,622,794 | B2 | 9/2003 | Zisk, Jr. |
| 6,632,527 | B1 | 10/2003 | McDaniel et al. |
| 6,635,732 | B2 | 10/2003 | Mentak |
| 6,667,029 | B2 | 12/2003 | Zhong et al. |
| 6,679,324 | B2 | 1/2004 | Den Boer et al. |
| 6,692,766 | B1 | 2/2004 | Rubinstein et al. |
| 6,699,503 | B1 | 3/2004 | Sako et al. |
| 6,699,611 | B2 | 3/2004 | Kim et al. |
| 6,712,154 | B2 | 3/2004 | Cook et al. |
| 6,722,437 | B2 | 4/2004 | Vercaemer et al. |
| 6,786,285 | B2 | 9/2004 | Johnson et al. |
| 6,817,416 | B2 | 11/2004 | Wilson et al. |
| 6,820,690 | B2 | 11/2004 | Vercaemer et al. |
| 6,830,104 | B2 | 12/2004 | Nguyen et al. |
| 6,831,044 | B2 | 12/2004 | Constien |
| 6,840,321 | B2 | 1/2005 | Restarick et al. |
| 6,857,476 | B2 | 2/2005 | Richards |
| 6,863,126 | B2 | 3/2005 | McGlothen et al. |
| 6,896,049 | B2 | 5/2005 | Moyes |
| 6,913,079 | B2 | 7/2005 | Tubel |
| 6,938,698 | B2 | 9/2005 | Coronado |
| 6,951,252 | B2 | 10/2005 | Restarick et al. |
| 6,959,764 | B2 | 11/2005 | Preston |
| 6,976,542 | B2 | 12/2005 | Henriksen et al. |
| 7,011,076 | B1 | 3/2006 | Weldon et al. |
| 7,032,675 | B2 | 4/2006 | Steele et al. |
| 7,059,410 | B2 | 6/2006 | Bousche et al. |
| 7,084,094 | B2 | 8/2006 | Gunn et al. |
| 7,159,656 | B2 | 1/2007 | Eoff et al. |
| 7,185,706 | B2 | 3/2007 | Freyer |
| 7,207,385 | B2 | 4/2007 | Smith et al. |

| | | | |
|---|---|---|---|
| 7,252,162 | B2 | 8/2007 | Akinlade et al. |
| 7,258,166 | B2 | 8/2007 | Russell |
| 7,264,047 | B2 | 9/2007 | Brezinski et al. |
| 7,290,606 | B2 | 11/2007 | Coronado et al. |
| 7,290,610 | B2 | 11/2007 | Corbette et al. |
| 7,318,472 | B2 | 1/2008 | Smith |
| 7,322,412 | B2 | 1/2008 | Badalamenti et al. |
| 7,325,616 | B2 | 2/2008 | Lopez de Cardenas et al. |
| 7,360,593 | B2 | 4/2008 | Constien |
| 7,367,399 | B2 | 5/2008 | Steele et al. |
| 7,395,858 | B2 | 7/2008 | Barbosa et al. |
| 7,398,822 | B2 | 7/2008 | Meijer et al. |
| 7,409,999 | B2 | 8/2008 | Henriksen et al. |
| 7,413,022 | B2 | 8/2008 | Broome et al. |
| 7,451,814 | B2 | 11/2008 | Graham et al. |
| 7,469,743 | B2 | 12/2008 | Richards |
| 7,581,593 | B2 | 9/2009 | Pankratz et al. |
| 7,621,326 | B2 | 11/2009 | Crichlow |
| 7,644,854 | B1 | 1/2010 | Holmes et al. |
| 7,647,966 | B2 | 1/2010 | Cavender et al. |
| 7,673,678 | B2 | 3/2010 | MacDougall et al. |
| 7,757,757 | B1 | 7/2010 | Vroblesky |
| 7,931,081 | B2 | 4/2011 | Sponchia |
| 2002/0020527 | A1 | 2/2002 | Kilaas |
| 2002/0125009 | A1 | 9/2002 | Wetzel et al. |
| 2002/0148610 | A1 | 10/2002 | Bussear et al. |
| 2002/0170717 | A1 | 11/2002 | Venning et al. |
| 2003/0221834 | A1 | 12/2003 | Hess et al. |
| 2004/0052689 | A1 | 3/2004 | Yao |
| 2004/0060705 | A1 | 4/2004 | Kelley |
| 2004/0094307 | A1 | 5/2004 | Daling et al. |
| 2004/0144544 | A1 | 7/2004 | Freyer |
| 2004/0159447 | A1 | 8/2004 | Bissonnette et al. |
| 2004/0194971 | A1 | 10/2004 | Thomson |
| 2004/0244988 | A1 | 12/2004 | Preston |
| 2005/0016732 | A1 | 1/2005 | Brannon et al. |
| 2005/0086807 | A1 | 4/2005 | Richard et al. |
| 2005/0126776 | A1 | 6/2005 | Russell |
| 2005/0178705 | A1 | 8/2005 | Broyles et al. |
| 2005/0189119 | A1 | 9/2005 | Gynz-Rekowski |
| 2005/0199298 | A1 | 9/2005 | Farrington |
| 2005/0207279 | A1 | 9/2005 | Chemali et al. |
| 2005/0241835 | A1 | 11/2005 | Burris et al. |
| 2005/0274515 | A1 | 12/2005 | Smith et al. |
| 2006/0032630 | A1 | 2/2006 | Heins |
| 2006/0042798 | A1 | 3/2006 | Badalamenti et al. |
| 2006/0048936 | A1 | 3/2006 | Fripp et al. |
| 2006/0048942 | A1 | 3/2006 | Moen et al. |
| 2006/0076150 | A1 | 4/2006 | Coronado et al. |
| 2006/0086498 | A1 | 4/2006 | Wetzel et al. |
| 2006/0108114 | A1 | 5/2006 | Johnson |
| 2006/0118296 | A1 | 6/2006 | Dybevik et al. |
| 2006/0124360 | A1 | 6/2006 | Lee et al. |
| 2006/0157242 | A1 | 7/2006 | Graham et al. |
| 2006/0175065 | A1 | 8/2006 | Ross |
| 2006/0185849 | A1 | 8/2006 | Edwards et al. |
| 2006/0250274 | A1 | 11/2006 | Mombourquette et al. |
| 2006/0272814 | A1 | 12/2006 | Broome et al. |
| 2006/0273876 | A1 | 12/2006 | Pachla et al. |
| 2007/0012444 | A1 | 1/2007 | Horgan et al. |
| 2007/0039741 | A1 | 2/2007 | Hailey, Jr. |
| 2007/0044962 | A1 | 3/2007 | Tibbles |
| 2007/0045266 | A1 | 3/2007 | Sandberg et al. |
| 2007/0056729 | A1 | 3/2007 | Pankratz et al. |
| 2007/0131434 | A1 | 6/2007 | MacDougall et al. |
| 2007/0181299 | A1 | 8/2007 | Chung et al. |
| 2007/0209799 | A1 | 9/2007 | Vinegar et al. |
| 2007/0246210 | A1 | 10/2007 | Richards |
| 2007/0246213 | A1 | 10/2007 | Hailey, Jr. |
| 2007/0246225 | A1 | 10/2007 | Hailey, Jr. et al. |
| 2007/0246407 | A1 | 10/2007 | Richards et al. |
| 2007/0272408 | A1 | 11/2007 | Zazaovsky et al. |
| 2007/0289749 | A1 | 12/2007 | Wood et al. |
| 2008/0035349 | A1 | 2/2008 | Richard |
| 2008/0035350 | A1 | 2/2008 | Henriksen et al. |
| 2008/0053662 | A1 | 3/2008 | Williamson et al. |
| 2008/0135249 | A1 | 6/2008 | Fripp et al. |
| 2008/0149323 | A1 | 6/2008 | O'Malley et al. |
| 2008/0149351 | A1 | 6/2008 | Marya et al. |
| 2008/0169099 | A1 | 7/2008 | Pensgaard |
| 2008/0236839 | A1 | 10/2008 | Oddie |
| 2008/0236843 | A1 | 10/2008 | Scott et al. |
| 2008/0251255 | A1 | 10/2008 | Forbes et al. |
| 2008/0283238 | A1 | 11/2008 | Richards et al. |
| 2008/0296023 | A1 | 12/2008 | Willauer |
| 2008/0314590 | A1 | 12/2008 | Patel |
| 2009/0056816 | A1 | 3/2009 | Arov et al. |
| 2009/0057014 | A1 | 3/2009 | Richard et al. |
| 2009/0071646 | A1 | 3/2009 | Pankratz et al. |
| 2009/0101330 | A1 | 4/2009 | Johnson |
| 2009/0101342 | A1 | 4/2009 | Gaudette et al. |
| 2009/0133869 | A1 | 5/2009 | Clem |
| 2009/0133874 | A1 | 5/2009 | Dale et al. |
| 2009/0139717 | A1 | 6/2009 | Richard et al. |
| 2009/0139727 | A1 | 6/2009 | Tanju et al. |
| 2009/0194282 | A1 | 8/2009 | Beer et al. |
| 2009/0205834 | A1 | 8/2009 | Garcia et al. |
| 2009/0301704 | A1 | 12/2009 | Dillett et al. |
| 2010/0126720 | A1 | 5/2010 | Kaiser et al. |
| 2011/0042096 | A1* | 2/2011 | Nutley et al. ..... 166/369 |

FOREIGN PATENT DOCUMENTS

| | | | |
|---|---|---|---|
| GB | 1492345 | | 6/1976 |
| GB | 2341405 | | 3/2000 |
| JP | 59089383 | | 5/1984 |
| SU | 1335677 | | 8/1985 |
| WO | 9403743 | | 2/1994 |
| WO | 0079097 | | 12/2000 |
| WO | 0165063 | | 9/2001 |
| WO | 0177485 | | 10/2001 |
| WO | 0192681 | A1 | 12/2001 |
| WO | 02075110 | | 9/2002 |
| WO | 2004018833 | A1 | 3/2004 |
| WO | 2006015277 | | 2/2006 |
| WO | 2008092241 | A1 | 8/2008 |

OTHER PUBLICATIONS

Baker Oil Tools, Product Report, Sand Control Systems: Screens, Equalizer CF Product Family No. H48688. Nov. 2005. 1 page.

Bercegeay, E. P., et al. "A One-Trip Gravel Packing System," SPE 4771, New Orleans, Louisiana, Feb. 7-8, 1974. 12 pages.

Burkill, et al. Selective Steam Injection in Open hole Gravel-packed Liner Completions SPE 5958.

Concentric Annular Pack Screen (CAPS) Service; Retrieved From Internet on Jun. 18, 2008. http://www.halliburton.com/ps/Default.aspx?navid=81&pageid=273&prodid=PRN%3a%3aIQSHFJ2QK.

Determination of Perforation Schemes to Control Production and Injection Profiles Along Horizontal; Asheim, Harald, Norwegian Institute of Technology; Oudeman, Pier, Koninklijke/Shell Exploratie en Producktie Laboratorium; SPE Drilling and Completion, vol. 12, No. 1, March; pp. 13-18; 1997 Society of Petroleum Engieneers.

Dikken, Ben J., SPE, Koninklijke/Shell E&P Laboratorium; "Pressure Drop in Horizontal Wells and Its Effect on Production Performance"; Nov. 1990, JPT; Copyright 1990, Society of Petroleum Engineers; pp. 1426-1433.

Dinarvand. R., D'Emanuele, A (1995) The use of thermoresponsive hydrogels for on-off release of molecules, J. Control. Rel. 36 221-227.

E.L. Joly, et al. New Production Logging Technique for Horizontal Wells. SPE 14463 1988.

Hackworth, et al. "Development and First Application of Bistable Expandable Sand Screen," Society of Petroleum Engineers: SPE 84265. Oct. 5-8, 2003. 14 pages.

Henry Restarick, "Horizontal Completion Options in Reservoirs with Sand Problems". SPE 29831. Mar. 11-14, 1995. pp. 545-560.

Ishihara, K., Hamada, N., Sato, S., Shinohara, I., (1984) Photoinduced swelling control of amphiphdilic azoaromatic polymer membrane. J. Polym. Sci., Polm. Chem. Ed. 22: 121-128.

Mathis, Stephen P. "Sand Management: A Review of Approaches and Conerns," SPE 82240, The Hague, The Netherlands, May 13-14, 2003. 7 pages.

Optimization of Commingled Production Using Infinitely Variable Inflow Control Valves; M.M, J.J. Naus, Delft University of Technology (DUT), Shell International Exploration and production (SIEP); J.D. Jansen, DUT and SIEP; SPE Annual Technical Conference and Exhibtion, Sep. 26-29 Houston, Texas, 2004, Society of Patent Engineers.
Pardo, et al. "Completion, Techniques Used in Horizontal Wells Drilled in Shallow Gas Sands in the Gulf of Mexio". SPE 24842. Oct. 4-7, 1992.
R. D. Harrison Jr., et al. Case Histories: New Horizontal Completion Designs Facilitate Development and Increase Production Capabilites in Sandstone Reservoirs. SPE 27890. Wester Regional Meeting held in Long Beach, CA Mar. 23-25, 1994.
"Rapid Swelling and Deswelling of Thermoreversible Hydrophobically Modified Poly (N-Isopropylacrylamide) Hydrogels Prepared by freezing Polymerisation", Xue, W., Hamley, I.W. and Huglin, M.B., 2002, 43(1) 5181-5186.
International Search Report and Written Opinion, Mailed Feb. 2, 2010, International Appln. No. PCT/US2009/049661, Written Opinion 7 pages, International Search Report 3 pages.
Tanaka, T., Nishio, I., Sun, S.T., Uena-Nisho, S. (1982) Collapse of gels in an electric field, Science, 218-467-469.
Tanaka, T., Ricka, J., (1984) Swelling of Ionic gels: Quantitative performance of the Donnan Thory, Macromolecules, 17, 2916-2921.
"Thermoreversible Swelling Behavior of Hydrogels Based on N-Isopropylacrylamide with a Zwitterionic Comonomer". Xue, W., Champ, S. and Huglin, M.B. 2001, European Polymer Journal, 37(5) 869-875.
Notification of Transmittal of the International Search Report and the Written Opinion of the International Searching Authority; PCT Application No. PCT/US2010/034747; Mailed Dec. 13, 2010; Korean Intellectualy Property Office.
International Search Report; Date of Mailing Jan. 27, 2011; International Application No. PCT/US2010/034752; 3 pages.
International Search Report and Written Opinion; Date of Mailing Jan. 13, 2011; International Appln No. PCT/US2010/034750; International Search Report 5 pages; Written Opinion 3 pages.
International Search Report and Written Opinion; Date of Mailing Jan. 27, 2011, International Appln No. PCT/US2010/034758; International Search Report 10 pages; Written Opinion 3 pages.
Baker Hughes, Thru-Tubing Intervention, Z-Seal Technology, Z-Seal Metal-to-Metal Sealing Technology Shifts the Paradigm,http://www.bakerhughes.com/assets/media/brochures/4d121c2bfa7e1c7c9c00001b/file/3057t-ttintervention_catalog-1110.pdf.pdf&fs=4460520, 2010 pp. 79-81.
MacKenzie, Gordon Adn Garfield, Garry, Baker Oil Tools, Wellbore Isolation Intervention Devices Utilizing a Metal-to-Metal Rather Than an Elastomeric Sealing Methodology, SPE 109791, Society of Petroleum Engineers, Presentation at the 2007 SPE Annual Technical Conference and Exhibition held in Anaheim, California, U.S.A., Nov. 11-14, 2007, pp. 1-5.

* cited by examiner

DEVICE AND SYSTEM FOR WELL COMPLETION AND CONTROL AND METHOD FOR COMPLETING AND CONTROLLING A WELL

CROSS REFERENCE TO RELATED APPLICATION

The present application claims priority to U.S. Provisional Patent Application Ser. No. 61/052,919, filed May 13, 2008, and is a continuation of U.S. patent application Ser. No. 12/171,539, filed Jul. 11, 2008 which is a continuation in part of U.S. patent application Ser. No. 11/875,584, filed Oct. 19, 2007, the entire contents of which are specifically incorporated herein by reference.

BACKGROUND

Well completion and control are the most important aspects of hydrocarbon recovery short of finding hydrocarbon reservoirs to begin with. A host of problems are associated with both wellbore completion and control. Many solutions have been offered and used over the many years of hydrocarbon production and use. While clearly such technology has been effective, allowing the world to advance based upon hydrocarbon energy reserves, new systems and methods are always welcome to reduce costs or improve recovery or both.

SUMMARY

A screen assembly includes a tubular having one or more openings therein; a screen disposed about the tubular; and one or more devices disposed within the one or more openings, the devices each including a beaded matrix and a housing.

A method for completing a wellbore with a sand screen includes running A screen assembly includes a tubular having one or more openings therein; a screen disposed about the tubular; and one or more devices disposed within the one or more openings, the devices each including a beaded matrix and a housing into the wellbore; plugging the one or more devices; and pressuring up on the tubular to actuate another tool.

BRIEF DESCRIPTION OF THE DRAWINGS

Referring now to the drawings wherein like elements are numbered alike in the several Figures.

DETAILED DESCRIPTION

Figure 1:
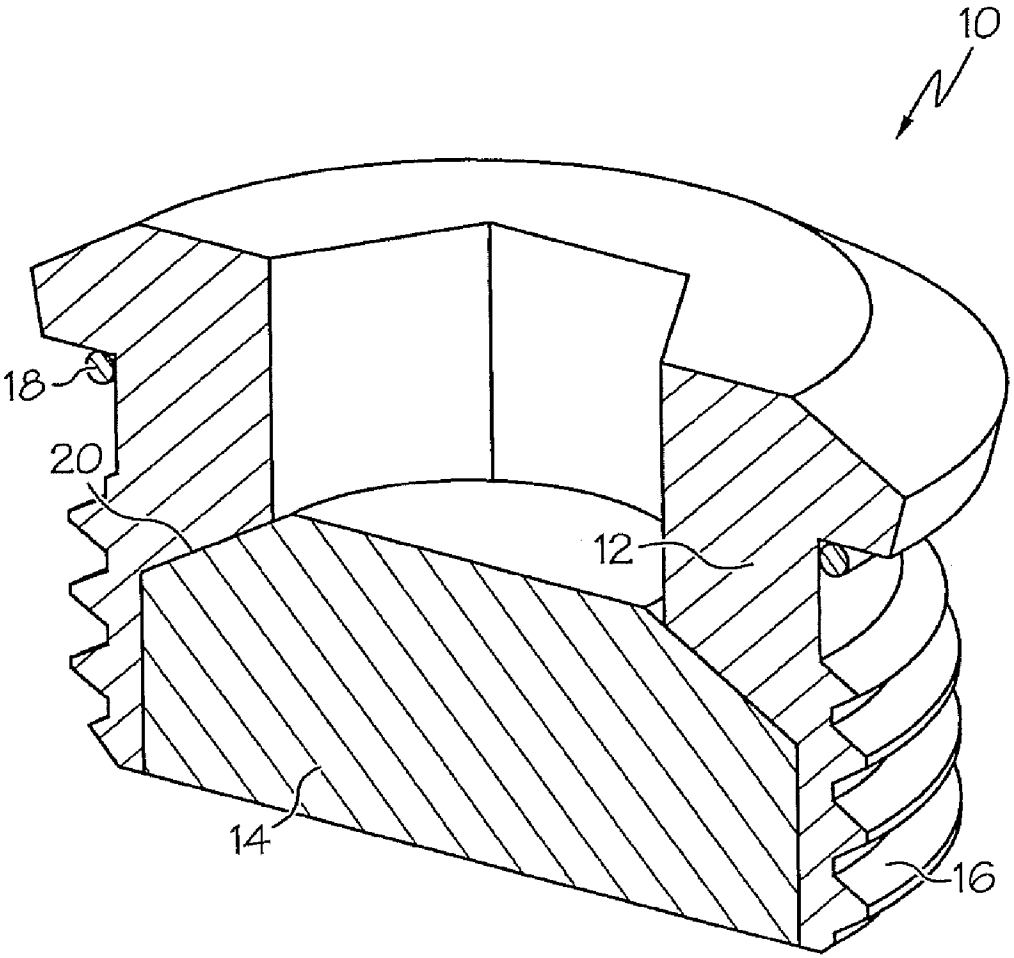
FIG. 1 is a perspective sectional view of a plug as disclosed herein.

Referring to FIG. 1, a beaded matrix plug flow control device 10 includes a plug housing 12 and a permeable material (sometimes referred to as beaded matrix) 14 disposed therein. The housing 12 includes in one embodiment a thread 16 disposed at an outside surface of the housing 12, but it is to be understood that any configuration providing securement to another member including welding is contemplated. In addition, some embodiments will include an o-ring or similar sealing structure 18 about the housing 12 to engage a separate structure such as a tubular structure with which the device 10 is intended to be engaged. In the FIG. 1 embodiment, a bore disposed longitudinally through the device is of more than one diameter (or dimension if not cylindrical). This creates a shoulder 20 within the inside surface of the device 10. While it is not necessarily required to provide the shoulder 20, it can be useful in applications where the device is rendered temporarily impermeable and might experience differential pressure thereacross. Impermeability of matrix 14 and differential pressure capability of the devices is discussed more fully later in this disclosure.

The matrix itself is described as "beaded" since the individual "beads" 30 are rounded though not necessarily spherical. A rounded geometry is useful primarily in avoiding clogging of the matrix 14 since there are few edges upon which debris can gain purchase.

The beads 30 themselves can be formed of many materials such as ceramic, glass, metal, etc. without departing from the scope of the disclosure. Each of the materials indicated as examples, and others, has its own properties with respect to resistance to conditions in the downhole environment and so may be selected to support the purposes to which the devices 10 will be put. The beads 30 may then be joined together (such as by sintering, for example) to form a mass (the matrix 14) such that interstitial spaces are formed therebetween providing the permeability thereof. In some embodiments, the beads will be coated with another material for various chemical and/or mechanical resistance reasons. One embodiment utilizes nickel as a coating material for excellent wear resistance and avoidance of clogging of the matrix 14. Further, permeability of the matrix tends to be substantially better than a gravel or sand pack and therefore pressure drop across the matrix 14 is less than the mentioned constructions. In another embodiment, the beads are coated with a highly hydrophobic coating that works to exclude water in fluids passing through the device 10.

In addition to coatings or treatments that provide activity related to fluids flowing through the matrix 14, other materials may be applied to the matrix 14 to render the same temporarily (or permanently if desired) impermeable.

Each or any number of the devices 10 can easily be modified to be temporarily (or permanently) impermeable by injecting a hardenable (or other property causing impermeability) substance 26 such as a bio-polymer into the interstices of the beaded matrix 14 (see FIG. 3 for a representation of devices 10 having a hardenable substance therein). Determination of the material to be used is related to temperature and length of time for undermining (dissolving, disintegrating, fluidizing, subliming, etc) of the material desired. For example, Polyethylene Oxide (PEO) is appropriate for temperatures up to about 200 degrees Fahrenheit, Polywax for temperatures up to about 180 degrees Fahrenheit; PEO/Polyvinyl Alcohol (PVA) for temperatures up to about 250 degrees Fahrenheit; Polylactic Acid (PLA) for temperatures above 250 degrees Fahrenheit; among others. These can be dissolved using acids such as Sulfamic Acid, Glucono delta lactone, Polyglycolic Acid, or simply by exposure to the downhole environment for a selected period, for example. In one embodiment, Polyvinyl Chloride (PVC) is rendered molten or at least relatively soft and injected into the interstices of the beaded matrix and allowed to cool. This can be accomplished at a manufacturing location or at another controlled location such as on the rig. It is also possible to treat the devices in the downhole environment by pumping the hardenable material into the devices in situ. This can be done selectively or collectively of the devices 10 and depending upon the material selected to reside in the interstices of the devices; it can be rendered soft enough to be pumped directly from the surface or other remote location or can be supplied via a tool run to the vicinity of the devices and having the capability of heating the material adjacent the devices. In either case, the material is then applied to the devices. In such condition, the device 10 will hold a substantial pressure differential that may exceed 10,000 PSI.

The PVC, PEO, PVA, etc. can then be removed from the matrix 14 by application of an appropriate acid or over time as selected. As the hardenable material is undermined, target fluids begin to flow through the devices 10 into a tubular 40 in which the devices 10 are mounted. Treating of the hardenable substance may be general or selective. Selective treatment is by, for example, spot treating, which is a process known to the industry and does not require specific disclosure with respect to how it is accomplished.

In a completion operation, the temporary plugging of the devices can be useful to allow for the density of the string to be reduced thereby allowing the string to "float" into a highly deviated or horizontal borehole. This is because a lower density fluid (gas or liquid) than borehole fluid may be used to fill the interior of the string and will not leak out due to the hardenable material in the devices. Upon conclusion of completion activities, the hardenable material may be removed from the devices to facilitate production through the completion string.

Another operational feature of temporarily rendering impermeable the devices 10 is to enable the use of pressure actuated processes or devices within the string. Clearly, this cannot be accomplished in a tubular with holes in it. Due to the pressure holding capability of the devices 10 with the hardenable material therein, pressure actuations are available to the operator. One of the features of the devices 10 that assists in pressure containment is the shoulder 20 mentioned above. The shoulder 20 provides a physical support for the matrix 14 that reduces the possibility that the matrix itself could be pushed out of the tubular in which the device 10 resides.

In some embodiments, this can eliminate the use of sliding sleeves. In addition, the housing 12 of the devices 10 can be configured with mini ball seats so that mini balls pumped into the wellbore will seat in the devices 10 and plug them for various purposes.

As has been implied above and will have been understood by one of ordinary skill in the art, each device 10 is a unit that can be utilized with a number of other such units having the same permeability or different permeabilities to tailor inflow capability of the tubular 40, which will be a part of a string (not shown) leading to a remote location such as a surface location. By selecting a pattern of devices 10 and a permeability of individual devices 10, flow of fluid either into (target hydrocarbons) or out of (steam injection, etc.) the tubular can be controlled to improve results thereof. Moreover, with appropriate selection of a device 10 pattern a substantial retention of collapse, burst and torsional strength of the tubular 40 is retained. Such is so much the case that the tubular 40 can be itself used to drill into the formation and avoid the need for an after run completion string.

Figure 4:
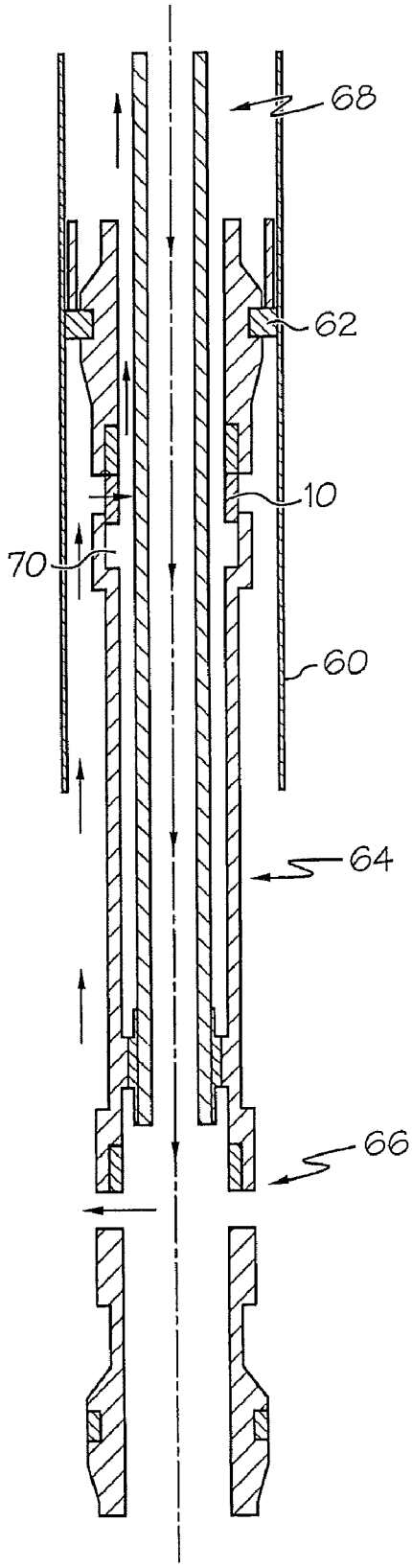
FIG. 4 is a schematic view of a tubular with one or more devices disposed therein and flow lines indicating the movement of a fluid such as cement filling an annular space.

In another utility, referring to FIG. 4, the devices 10 are usable as a tell tale for the selective installation of fluid media such as, for example, cement. In the illustration, a casing 60 having a liner hanger 62 disposed therein supports a liner 64. The liner 64 includes a cement sleeve 66 and a number of devices 10 (two shown). Within the liner 64 is disposed a workstring 68 that is capable of supplying cement to an annulus of the liner 64 through the cement sleeve 66. In this case, the devices 10 are configured to allow passage of mud through the matrix 14 to an annular space 70 between the liner 64 and the workstring 68 while excluding passage of cement. This is accomplished by either tailoring the matrix 14 of the specific devices 10 to exclude the cement or by tailoring the devices 10 to facilitate bridging or particulate matter added to the cement. In either case, since the mud will pass through the devices 10 and the cement will not, a pressure rise is seen at the surface when the cement reaches the devices 10 whereby the operator is alerted to the fact that the cement has now reached its destination and the operation is complete. In an alternate configuration, the devices 10 may be selected so as to pass cement from inside to outside the tubular in some locations while not admitting cement to pass in either direction at other locations. This is accomplished by manufacturing the beaded matrix 14 to possess interstices that are large enough for passage of the cement where it is desired that cement passes the devices and too small to allow passage of the solid content of the cement at other locations. Clearly, the grain size of a particular type of cement is known. Thus if one creates a matrix 14 having an interstitial space that is smaller than the grain size, the cement will not pass but will rather be stopped against the matrix 14 causing a pressure rise.

Figure 5:
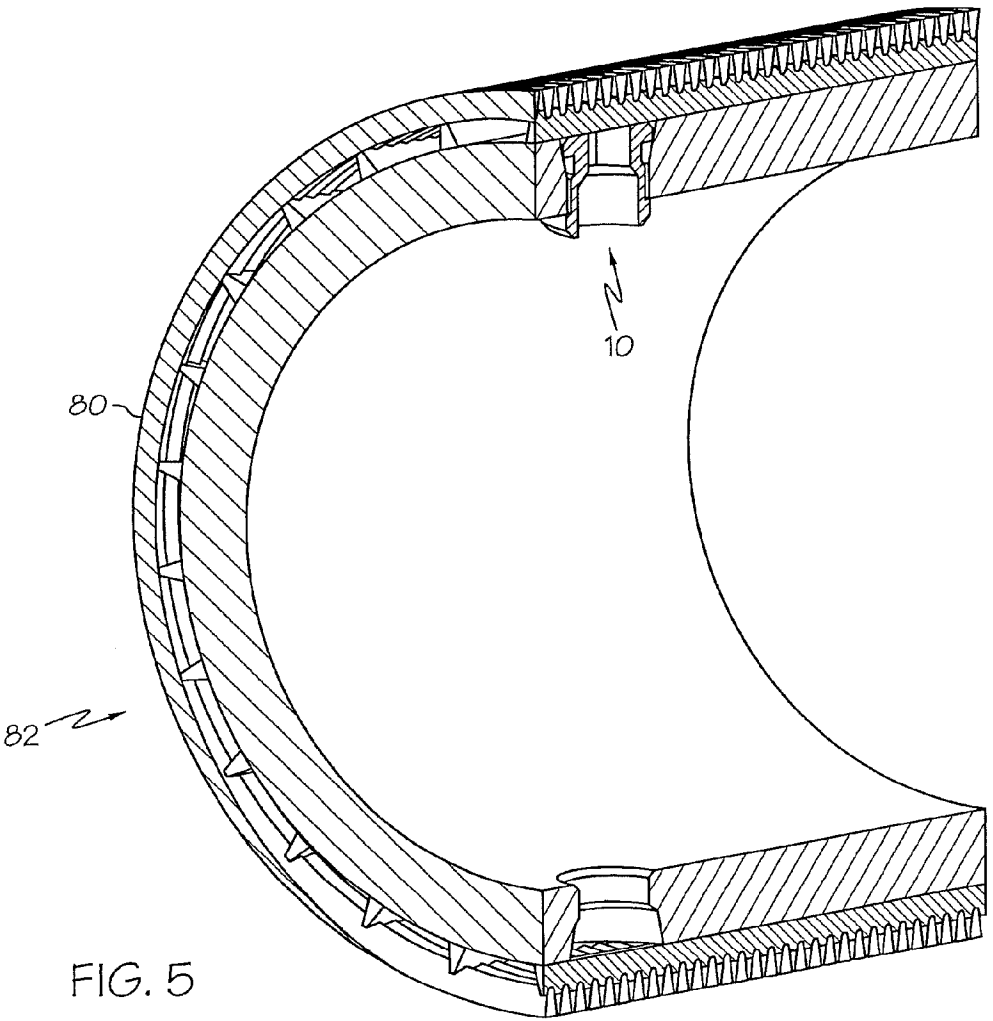
FIG. 5 is a schematic sectional view of a tubular with one or more devices disposed therein and a sand screen disposed therearound.

In another embodiment, the devices 10 in tubular 40 are utilized to supplement the function of a screen 80. This is illustrated in FIG. 5. Screens, it is known, cannot support any significant differential pressure without suffering catastrophic damage thereto. Utilizing the devices 10 as disclosed herein, however, a screen segment 82 can be made pressure differential insensitive by treating the devices 10 with a hardenable material as discussed above. The function of the screen can then be fully restored by dissolution or otherwise undermining of the hardenable material in the devices 10. Due to the configuration of devices 10, the pressure differential potential of upwards of 10,000 PSI. This is in part due to the beaded matrixes themselves because of the structural integrity of the beads and the three dimensional structure created by bonding them together through for example sintering. The pressure differential holding capacity is increased further but the structure of the housing 12 of devices 12. More specifically, it is the shoulder 20 that provides a significant amount of resistance to pressure differential from the inside of the tubular to the outside of the tubular. This enables not only running pressures to be kept from the screen but also enables the operator to use pressure up actuation techniques while the beaded matrixes are plugged without risking damage to the screens 80. Subsequent to operations requiring or utilizing a pressure differential, the beaded matrixes can be opened by undermining of the plugging configuration.

Figure 2:
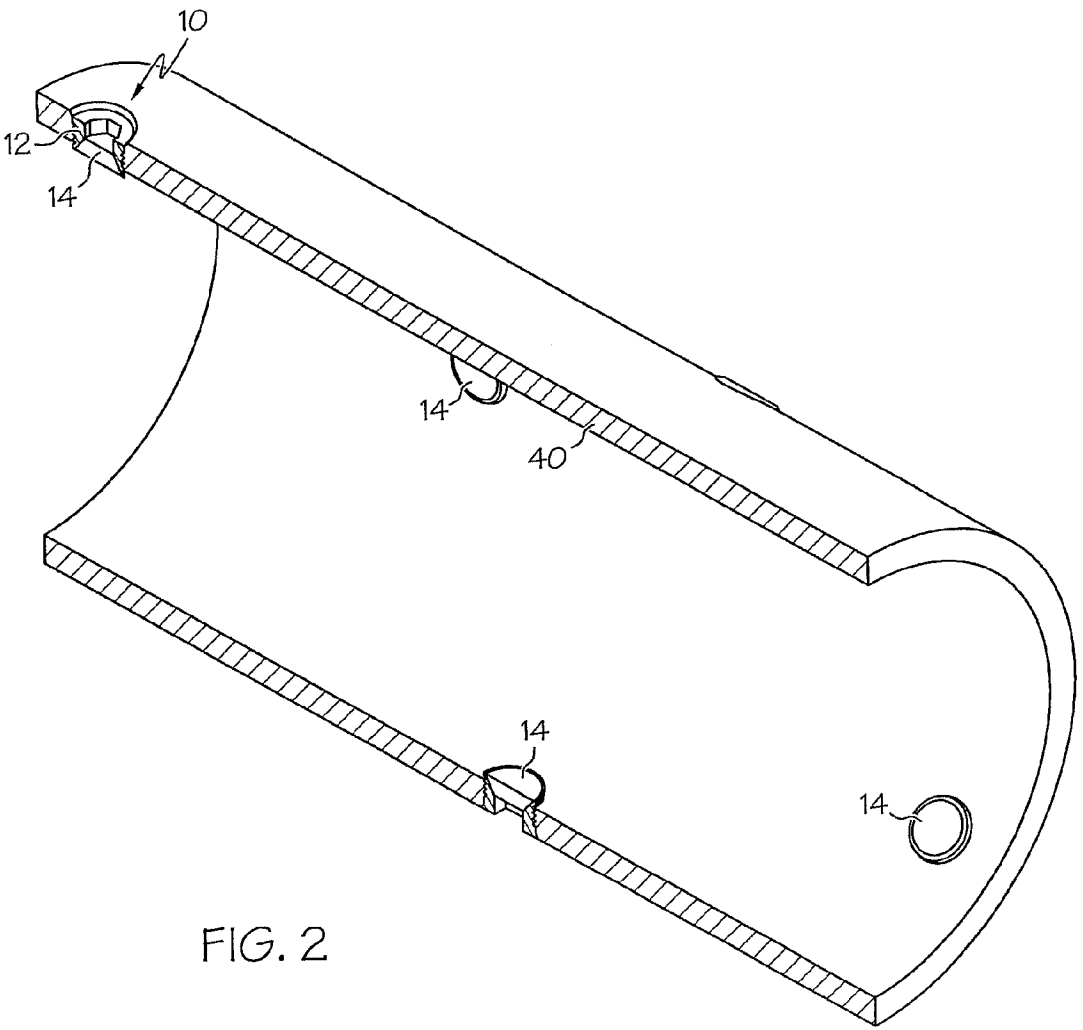
FIG. 2 is a schematic sectional illustration of a tubular member having one or more of the plugs of FIG. 1 installed therein.
Figure 3A:
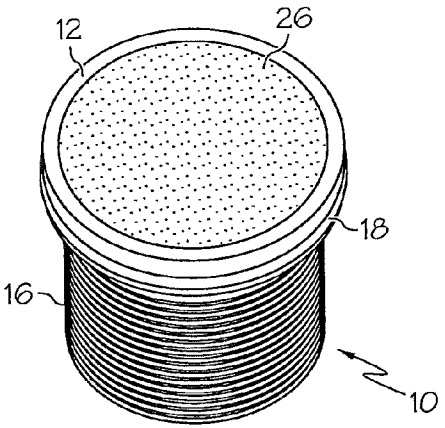
FIGS. 3A-3D are sequential views of a device having a hardenable and undeterminable substance therein to hold differential pressure and illustrating the undermining of the material.
Figure 3B:
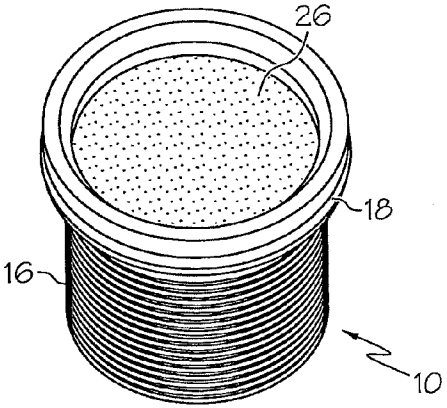
Figure 3C:
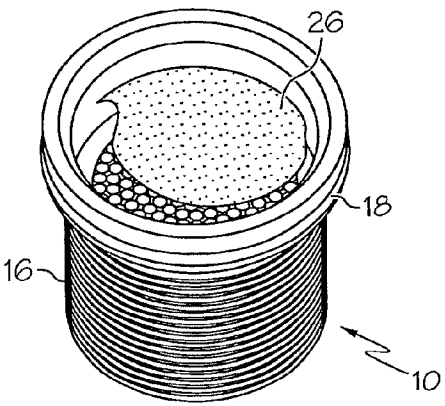
Figure 3D:
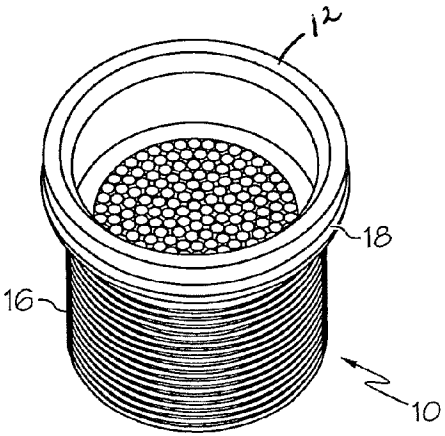
Figure 6:
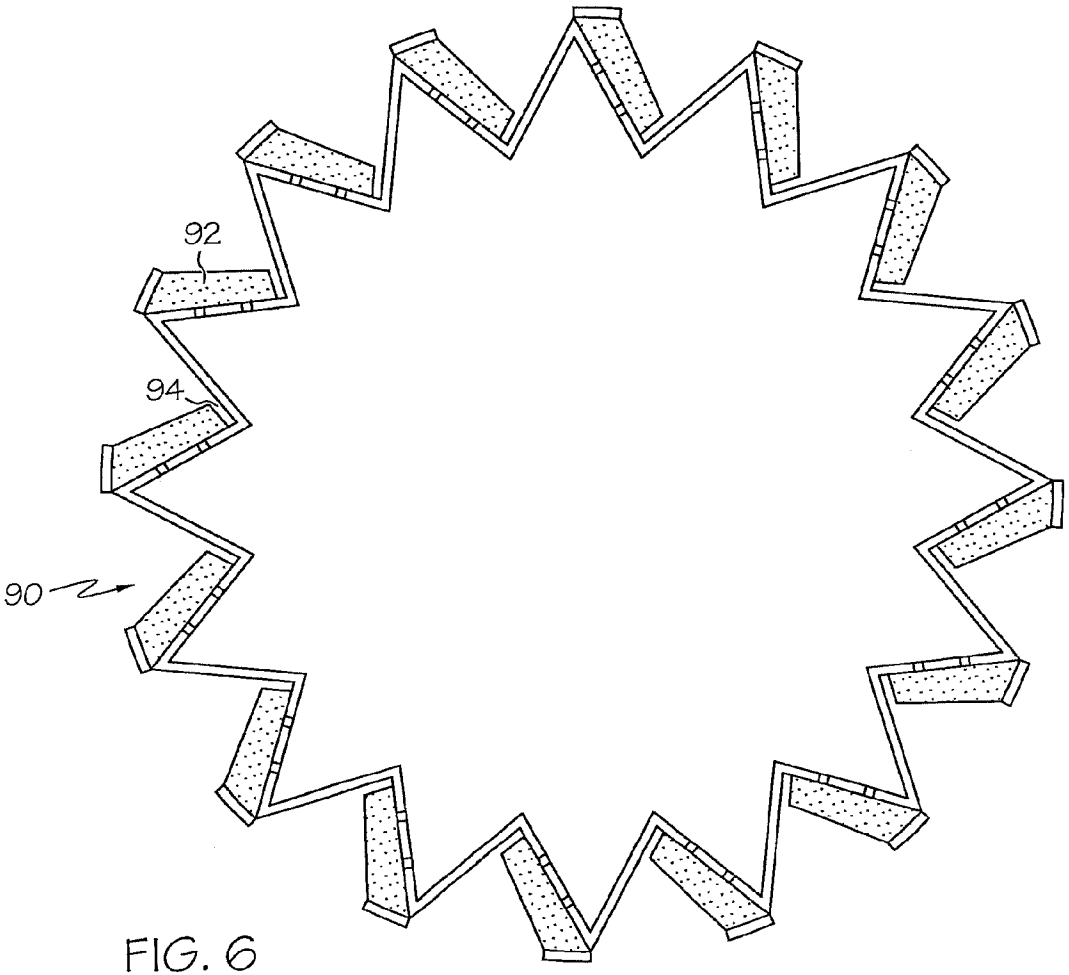
FIG. 6 is a schematic view of an expandable configuration having flow ports and a beaded matrix.

Referring to FIG. 6, an expandable liner 90 is illustrated having a number of beaded matrix areas 90 supplied thereon. These areas 92 are intended to be permeable or renderable impermeable as desired through means noted above but in addition allow the liner to be expanded to a generally cylindrical geometry upon the application of fluid pressure or mechanical expansion force. The liner 90 further provides flex channels 94 for fluid conveyance. Liner 90 provides for easy expansion due to the accordion-like nature thereof. It is to be understood, however, that the tubular of FIG. 2 is also expandable with known expansion methods and due to the relatively small change in the openings in tubular 40 for devices 10, the devices 10 do not leak.

It is noted that while in each discussed embodiment the matrix 14 is disposed within a housing 12 that is itself attachable to the tubular 40, it is possible to simply fill holes in the tubular 40 with the matrix 14 with much the same effect. In order to properly heat treat the tubular 40 to join the beads however, a longer oven would be required.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. A screen assembly comprising:

a tubular having one or more openings therein;

a screen disposed about the tubular;

one or more devices disposed within the one or more openings, the devices each including a beaded matrix and a housing.

2. The screen assembly as claimed in claim 1 wherein the housing further includes a shoulder radially outwardly located relative to the beaded matrix.

3. The screen assembly as claimed in claim 1 wherein the beaded matrix is supported by the shoulder against radially outward displacement.

4. The screen assembly as claimed in claim 1 wherein the devices will hold pressure at the inside of the tubular in excess of 3,500 PSI.

5. The screen assembly as claimed in claim 1 wherein each the devices are each receptive to a plugging configuration.

6. The screen assembly as claimed in claim 5 wherein the plugging configuration is a ball for each device.

7. The screen assembly as claimed in claim 5 wherein the plugging configuration is a material disposable within interstitial spaces within the beaded matrix.

8. The screen assembly as claimed in claim 7 wherein the material is undeterminable to render the beaded matrix permeable.

9. The screen assembly as claimed in claim 1 wherein each device is threadedly attached to the tubular in each opening.

10. The screen assembly as claimed in claim 9 wherein the thread is cylindrical.

11. A method for completing a wellbore with a sand screen comprising:

running a screen assembly as claimed in claim 1 into the wellbore;

plugging the one or more devices;

pressuring up on the tubular to actuate another tool.

12. The method as claimed in claim 11 further comprising:

undermining the plugging of the one or more devices;

establishing flow through the one or more devices.

13. The method as claimed in claim 11 wherein the plugging occurs prior to the running.

14. The method as claimed in claim 11 wherein the plugging occurs subsequent to the running.

15. The method as claimed in claim 11 wherein the pressuring is greater than 500 PSI.

16. The method as claimed in claim 12 wherein the undermining is by applying acid to the material.

17. The method as claimed in claim 12 wherein the undermining is by durational exposure to wellbore downhole environment.

18. The method as claimed in claim 12 wherein the establishing is by straining a target fluid through the screen and flowing the target fluid through the devices.

* * * * *